United States Patent [19]

Bowman et al.

[11] Patent Number: 4,604,759

[45] Date of Patent: Aug. 12, 1986

[54] FIREFIGHTER'S SUIT WITH WATERPROOF COLLAR

[75] Inventors: J. Robert Bowman, Manchester; Eleanor T. Pinkham, Northwood, both of N.H.

[73] Assignee: Globe Manufacturing Company, Pittsfield, N.H.

[21] Appl. No.: 780,339

[22] Filed: Sep. 26, 1985

Related U.S. Application Data

[63] Continuation-in-part of Ser. No. 761,812, Aug. 2, 1985, abandoned.

[51] Int. Cl.[4] ..... A41D 10/00

[52] U.S. Cl. ..... 2/81; 2/87; 2/975; 2/98

[58] Field of Search ..... 2/81, 87, 96, 98, 97

[56] References Cited

U.S. PATENT DOCUMENTS

| | | | |
|---|---|---|---|
| 2,709,667 | 5/1955 | Grubb et al. | 2/81 X |
| 4,034,417 | 7/1977 | Ellis | 2/81 |
| 4,502,153 | 3/1985 | Lapedes et al. | 2/81 |
| 4,507,806 | 3/1985 | Coombs | 2/97 X |

*Primary Examiner*—Ronald Feldbaum
*Attorney, Agent, or Firm*—Watson, Cole, Grindle & Watson

[57] ABSTRACT

A firefighter's coat includes (1) a body portion comprised of a flame-resistant shell and a heat-resistant liner, (2) a collar portion comprised of a flame-resistant outer collar part and a fire-resistant inner collar part, the upper edge of the shell being stitched to the lower edge of the outer collar part to provide an outer neckline of the coat, the upper edge of the liner being stitched to the lower edge of the inner collar part to help provide an inner neckline of the coat, and (3) a waterproof interliner which extends from between the shell and the liner of the body portion upwardly between the outer and inner necklines without connection thereto except possibly at their opposite ends, and then between the outer and inner collar parts of the collar portion so as to provide a moisture barrier which prevents water which has seeped through the stitching along the outer neckline from penetrating through the coat to contact the wearer.

6 Claims, 5 Drawing Figures

FIREFIGHTER'S SUIT WITH WATERPROOF COLLAR

CROSS REFERENCE TO RELATED APPLICATION

The present application is a continuation-in-part application of Application Ser. No. 761,812, filed Aug. 2, 1985 now abandoned.

BACKGROUND OF THE INVENTION

1. Field of the Invention

The present invention relates to garments which can be used by firemen in and around fires, and more particularly to the coats of firefighters' suits 2. The Prior Art Firefighters' suits for use by firemen in and around fires are well known, such suits normally including a coat which includes a body portion and a collar portion, the body portion being constructed of an outer shell which is flame resistant and water resistant and a liner which is heat resistant, and the collar portion being constructed of an outer collar part which is flame resistant and water resistant and an inner collar part which is fire resistant. In known firefighters' coats the outer and inner collar parts are connected to the shell and liner of the body portion by stitching at the neckline which passes through all of these parts of the coat. As such, when the collar portion is extended upwardly for protection from flame, moisture and heat and water splashes against the outer collar part, small amounts of water can seep through the stitching at the neckline and thus penetrate through the coat and wet the wearer. This is of course an undesirable situation.

SUMMARY OF THE INVENTION

It is an object of the present invention to provide a firefighter's coat, especially a coat which is part of a firefighter's suit, through which moisture cannot pass and wet the wearer.

It is another object of the present invention to provide a firefighter's coat which has a waterproof body portion and a waterproof collar portion, and wherein no water can pass through the neckline of the coat where the collar portion is attached to the body portion.

According to the present invention, the firefighter's coat comprises a body portion which includes a flame-resistant shell and a heat-resistant liner, a collar portion which includes a flame-resistant outer collar part and a fire-resistant inner collar part, at least a portion of the upper edge of the shell being stitched to the lower edge of the outer collar part to form an outer neckline of the coat and the upper edge of the liner being stitched to a lower edge of the inner collar part to form at least a portion of an inner neckline of the coat, the firefighter's coat also including a waterproof interliner which extends from between the shell and the liner of the body portion upwardly between the outer and inner necklines without connection thereto (except perhaps at the very ends thereof), and then between the outer and inner collar parts of the collar portion so as to provide a moisture barrier between the outer and inner necklines of the coat. As such, any moisture which passes through the stitching which connects the shell to the outer collar part along the outer neckline will be prevented from penetrating through the coat to contact the wearer. Preferably, the interliner is stitched along its upper edge to the upper edges of the inner and outer collar parts which are stitched together to form the periphery of the collar portion.

A further understanding of the invention will be achieved by reference to the attached drawings, taken in conjunction with the following discussion.

DETAILED DESCRIPTION OF THE PREFERRED EMBODIMENT

A firefighter's coat 10 according to a preferred embodiment of the present inventioh is shown in FIGS. 1–5. It includes a body portion B, left and right sleeve portions LS and RS, a collar portion C and an interliner 60. In the following description of these elements the terms inner (inwardly) and outer, upper and lower, and left and right will be used as they would relate to an erect person who is wearing the firefighter's coat, the left and right front edges of the body portion being overlapped so as to close the front of the coat and its entire collar portion being in an upright orientation (see FIGS. 4 and 5).

Figure 1:
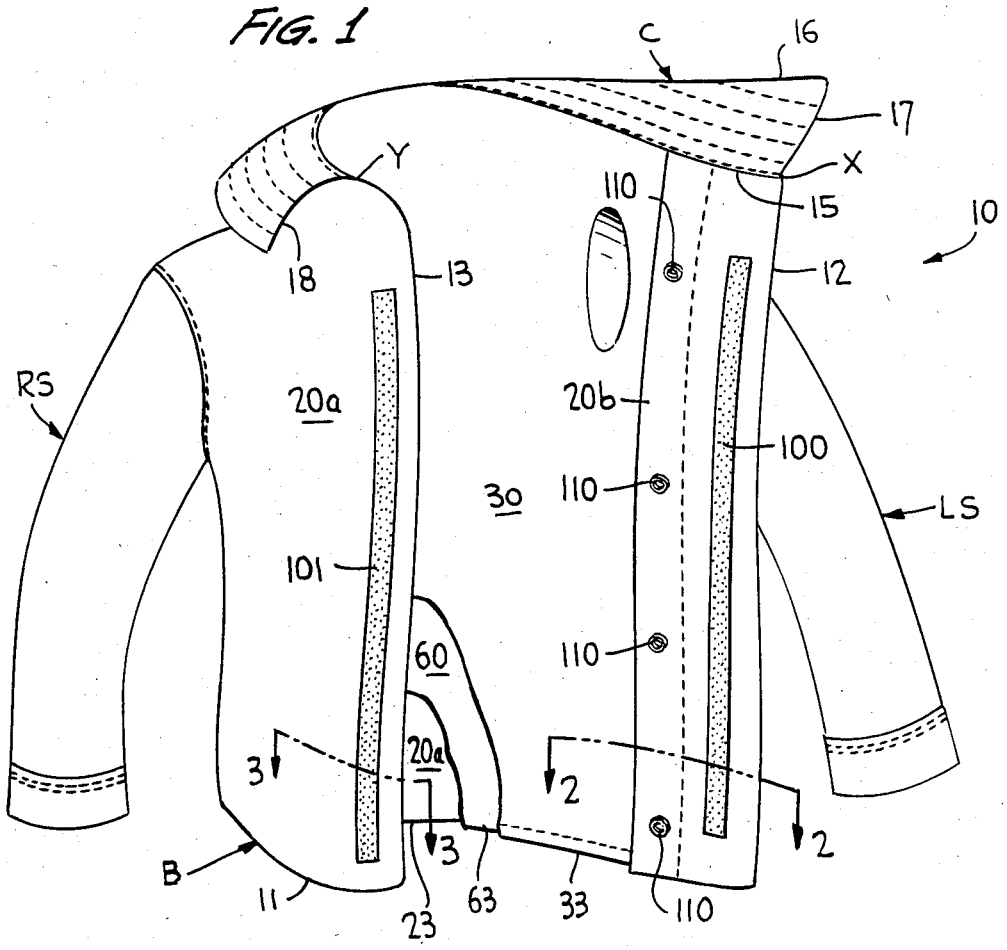
FIG. 1 shows a front perspective view, partially broken away, of a preferred embodiment of firefighter's coat according to the present invention, the left and right front edges of the body portion being separated so as to show the coat in an opened condition, the left side of the collar portion being shown in a generally upright orientration and its right side being shown in downward orientation.
Figure 2:
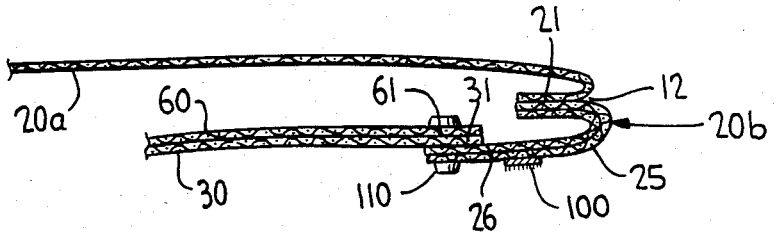
FIG. 2 shows a cross sectional view of the firefighter's coat shown in FIG. 1 as seen along line 2—2.
Figure 3:
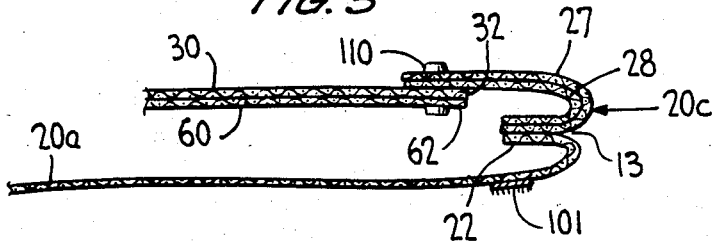
FIG. 3 shows a cross sectional view of the firefighter's coat shown in FIG. 1 as seen along line 3—3.
Figure 4:
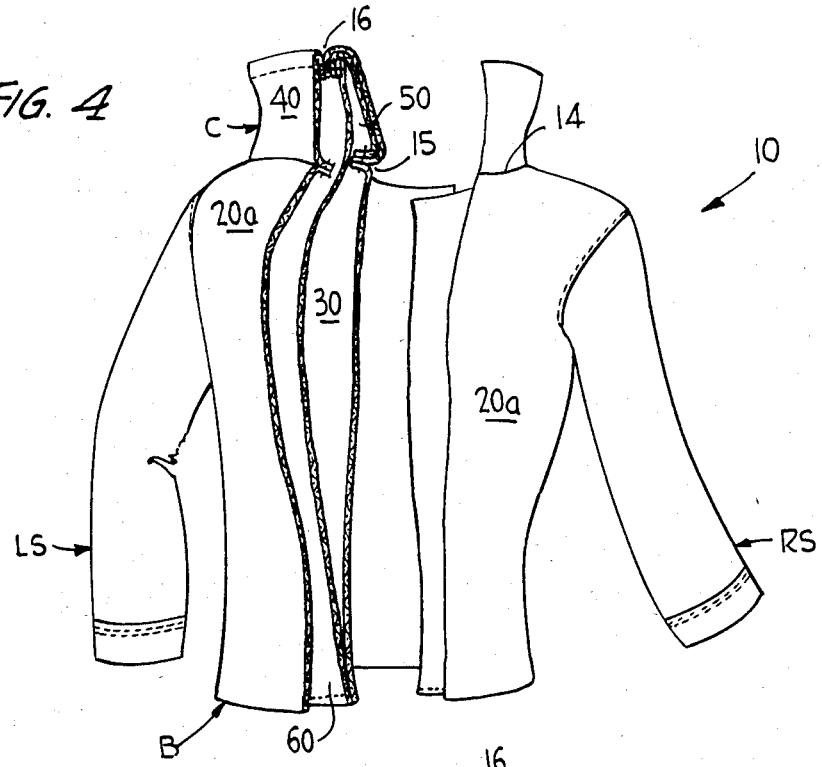
FIG. 4 shows a rear perspective view, partially broken away, of the firefighter's coat shown in FIG. 1, but wherein the left and right front edges of the body portion are overlapped to close the front of the coat and the collar portion is in an upright orientation.
Figure 5:
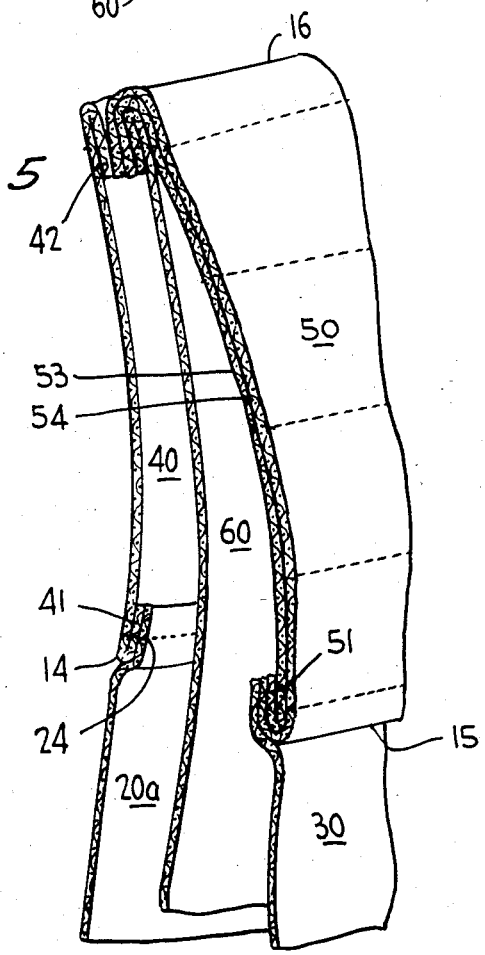
FIG. 5 shows, on an enlarged scale, a front perspective view of a detail of FIG. 4 showing the collar portion and an upper portion of the body portion of the firefighter's coat.

The body portion B includes a shell 20 and a liner 30, while the collar portion C includes an outer collar part 40 and an inner collar part 50. As best seen in FIGS. 1–3, the shell 20 includes a main section **20*a* which extends laterally around the body portion from a vertical left side edge 21 to a vertical right side edge 22 and vertically upwardly from a lower edge 23 to an upper edge 24. Its lower edge 23 provides the coat 10 with a bottom edge 11. Its upper edge 24, as shown in FIG. 5, is stitched to the lower edge 41 of the outer collar part 40 of the collar portion C to provide the coat with an outer neckline 14. The shell 20 also includes a left flap section 20*b* and a right flap section 20*c* which are respectively stitched along the vertical left side edge 21 and the vertical right side edge 22 of the main section 20*a*, thus providing the coat with left and right front edges 12 and 13 (see FIGS. 1, 2 and 3). The flap sections 20*b* and 20*c* also extend from lower edges (not labeled) which are generally parallel with the lower edge 23 of the main section 20*a* to upper edges (not labeled) which are generally parallel with the upper edge 24 of main section 20*a***. The upper edges of the left and right flap sections 20*b* and 20*c* are respectively stitched to the lower edge 51 of the inner collar part 50 of the collar portion C along associated left and right extents thereof to help provide the coat with an inner neckline 15. As indicated in FIGS. 2 and 3, the left flap section 20*b* mounts a vertically-extending Velcro® strip 100 which is cooperable with a vertically-extending Velcro® 101 mounted on the main section 20*a* near its vertical right side edge 22 so as to engage with one another when the left front edge 12 of the coat is lapped over the right front edge 13 to close the coat.

The main section 20*a* of the shell 20 is composed of a single layer of flame-resistant material, e.g., a fabric made of Nomex® III aramid fibers, Nomex being a registered trademark of E.I. duPont de Nemours & Co., Wilmington, Del. The left and right flap sections 20*b* and 20*c* are each composed of two layers, i.e., an inner layer 25,27 of a flame-resistant material, e.g., a fabric made of Nomex® III aramid fibers, and an outer layer 26, 28 of a waterproof material, e.g., a neoprene-coated fabric made of Nomex® aramid fibers.

As seen in FIGS. 2 and 3, the liner 30 extends laterally around the body portion B from a vertical left side edge 31 to a vertical right side edge 32, these vertical edges being positioned within the left and right front edges 12 and 13 of the coat 10 (which as noted above, are formed by the main section 20*a* and the left and right flap sections 20*b* and 20*c* of the shell 20 of the body portion B). It also extends vertically upwardly from a lower edge 33 to an upper edge 34, the upper edge 34 being stitched to the lower edge 51 of the inner collar part 50 of the collar portion C along a center extent thereof (see FIG. 5) to help provide the inner neckline 15. This liner 30 is composed of a single layer of heat-resistant material, e.g., a woven fabric or quilt made of Nomex® aramid fibers.

As noted previously, the outer collar part 40 of the collar portion C has its lower edge 41 stitched to the upper edge 24 of the main section 20*a* of the shell 20, this junction providing the coat with an outer neckline 14, while the inner collar part 50 has its lower edge 51 sequentially stitched, from its left to its right side, to the upper edge of the left flap section 20*b*, the upper edge 34 of the liner 30 and the upper edge of the right flap section 20*c*, this junction providing the coat with an inner neckline 15. The outer collar part 40 and the inner collar part 50 are otherwise stitched together along their corresponding upper edges 42,52 (see FIG. 5) to provide closed top, left and right peripheral edges 16, 17 and 18 of the collar portion C. The outer collar part 40 is composed of a single layer of a fire-resistant material, e.g., the same material used in constructing the shell 20, and the inner collar part 50 is composed of two layers, i.e., an outer layer 53 of a waterproof material, e.g., a neoprene-coated fabric made of Nomex® aramid fibers, and an inner layer 54 of a fire-resistant material, e.g., treated corduroy.

The interliner 60, which is composed of a single layer of waterproof material, e.g., a neoprene-coated fabric made of Nomex® aramid fibers, extends from a left side edge 61, which is in register with the left side edge 31 of the liner 30, to a right side edge 62, which is in register with the right side edge 32 of the liner 30, and vertically upwardly from a lower edge 63 which is in register with the lower edge 33 of the liner 30 to an upper edge 64 which extends to the upper edges 42,52 of the outer and inner collar parts 40,50 of the collar portion C. In other words, it extends from between the shell 20 and the liner 30 of the body portion B, upwardly between the outer and inner necklines 14 and 15, and between the outer collar part 40 and the inner collar part 50 of the collar portion C, and is stitched to the upper edges 42 and 52 of the outer and inner collar parts 40 and 50 where they form the top and side peripheral edges 16, 17 and 18 of collar portion C. It is also stitched along its lower edge 63 to the lower edge 33 of liner 30 and along its left and right side edges 61 and 62 to the left and right side edges 31 and 32 of the liner 30 from the bottom edge 33 of the liner 30 up almost to its upper edge 34; however, it is not stitched to any of the sections 20*a*, 20*b* and 20*c* of the shell 20 along the outer or inner necklines 14 or 15 (except possibly at the left and right ends thereof, see points X and Y in FIG. 1), nor is it stitched to the upper edge 34 of the liner 30 or to the lower edges 41 or 51 of the outer or inner collar parts 40 or 50 except possibly at points X and Y. Instead, it extends essentially freely upwardly between the inner and outer necklines 14 and 15 of the coat.

As seen in FIGS. 1, 2 and 3, snap fastening means 110 extend through both the interliner 60 and the liner 30 at vertically spaced apart locations along their associated left and right vertical side edges to cooperate with snap fastening means on the flap sections 20*b* and 20*c* of the shell 20 so as to releasably connect them together. However, the bottom edges 63,33 of the interliner 60 and the liner 30, which are themselves stitched together, are not in any way connected to the shell 20, but hang independently with respect thereto.

It should be noted that the stitching used in the coat is composed of threads of a fire-resistant material, e.g., Nomex® or Kelvar® aramid thread, Kelvar being a registered trademark of E. I. duPont de Nemours & Co., Wilmington, Del.

Because the outer neckline 14 of the coat (formed where the upper edge 24 of the main section 20*a* of the shell 20 is stitched to the lower edge 41 of the outer collar part 40) is not connected to the inner neckline 15 (formed where the upper edges of the flap sections 20*b* and 20*c* of the shell 20 and the upper edge 34 of the liner 30 are stitched to the lower edge 51 of the inner collar portion 50) except possibly at its ends of X and Y, and because the interliner 60 passes between these outer and inner necklines as it extends from the body portion B into the collar portion C without connection to the outer neckline 14 except possibly at its ends of X and Y, any moisture which penetrates through the stitching connecting the upper edge 24 of the main section 20*a* of the shell 20 to the lower edge 41 of the outer collar portion 40 along the outer neckline 14 will be prevented from penetrating through the interliner 60 and will, due to gravity, be caused to flow downwardly between the interliner 60 and the shell 20 and drain from between their (separated) bottom edges. As such, the wearer will be completely protected from exposure to water passing through the neckline of the coat.

Although a preferred embodiment of the invention has been shown and described, it is obvious that various modifications can be made therein and still fall within the scope of the appended claims. For example, although it is preferred that the interliner 60 be made of a continuous piece of waterproof material, it is possible that it be made of separate section of waterproof material, as long as the seems between the interconnected pieces are made waterproof.

We claim:

1. A firefighter's coat which includes a body portion, left and right sleeve portions and a collar portion; said body portion including a flame-resistant shell having an upper edge and a heat-resistant liner having an upper edge; said collar portion including a flame-resistant outer collar part having a lower edge and an upper edge, and a fire-resistant inner collar part having a lower edge and an upper edge; at least a portion of the upper edge of said shell being stitched to the lower edge of said outer collar part to provide an outer neckline for said coat, the upper edge of said liner being stitched to the lower edge of said inner collar part to provide at least a portion of an inner neckline for said coat, the upper edges of said outer and inner collar parts being stitched together to close said collar portion along the periphery thereof; and wherein said firefighter's coat includes a waterproof interliner which extends essentially freely from between said shell and said liner upwardly between said inner and outer necklines without connection thereto except possibly at their opposite ends, and then between said outer and inner collar parts, such that any moisture which seeps through the stitching along said outer neckline will be prevented from penetrating to said inner collar part or said liner and, due to gravity, will be caused to flow downwardly between said interliner and said shell.

2. The firefighter's coat as defined in claim 1, wherein said interliner has an upper edge which is stitched to the upper edges of the outer and inner collar parts of said collar portion.

3. The firefighter's coat as defined in claim 1, wherein the shell of said body portion and the outer collar part of said collar portion each comprise a fabric layer made of aramid fibers.

4. The firefighter's coat as defined in claim 1, wherein the liner of said body portion comprises a fabric layer made of aramid fibers.

5. The firefighter's coat as defined in claim 1, wherein said interliner comprises a fabric layer made of neoprene-coated aramid fibers.

6. The firefighter's coat as defined in claim 1, wherein the shell of said body portion includes a main section having left and right vertical side edges, and left and right flap sections which are respectively attached to the left and right vertical side edges of said main section, said left and right flap sections curving inwardly with respect to said main section to provide left and right front edges of said coat, said left and right flap sections having respective upper edges which are attached to corresponding extents of the lower edge of the outer collar part of said collar portion, and together with the upper edge of the liner of said body portion, providing said inner neckline of said coat.

* * * * *